United States Patent [19]

Jackson

[11] 4,099,825

[45] Jul. 11, 1978

[54] COAXIAL ADAPTER

[75] Inventor: Samuel H. Jackson, Ardsley, N.Y.

[73] Assignee: Kings Electronics Co., Inc., Tuckahoe, N.Y.

[21] Appl. No.: 827,217

[22] Filed: Aug. 24, 1977

[51] Int. Cl.[2] ..... H01R 17/06; H01R 33/30

[52] U.S. Cl. ..... 339/177 E; 200/51.1

[58] Field of Search ..... 339/19, 42, 91 B, 177 R, 339/177 E; 200/51.1, 51.09

[56] References Cited

U.S. PATENT DOCUMENTS

| | | | |
|---|---|---|---|
| 2,767,267 | 10/1956 | Zink, Jr. | 200/51.1 |
| 3,873,785 | 3/1975 | Lieberman | 200/51.1 |

FOREIGN PATENT DOCUMENTS

| | | | |
|---|---|---|---|
| 2,415,486 | 10/1974 | Fed. Rep. of Germany | 200/51.1 |

*Primary Examiner*—Neil Abrams

*Attorney, Agent, or Firm*—Bierman & Bierman

[57] ABSTRACT

Adapter plugs are known for interconnecting two types of R.F. connectors, for example a threaded type coaxial plug to a bayonet type coaxial plug. The present invention incorporates within a standard adapter envelope movable contact members which short the input connection when in the unmated condition, but which permits the adapter to function as a constant impedance transmission line when mated.

4 Claims, 3 Drawing Figures

COAXIAL ADAPTER

This invention is directed to a novel adapter plug of the type utilized, for example, in mating a typical coaxial, bayonet plug with a typical coaxial threaded plug.

Adapter plugs for the above purpose are now known in the art, but were either of the type which do not automatically provide shorting of the input circuit in the unmated condition (which had to be provided by external circuitry) or if automatic shorting was accomplished by the adapter plug, did not maintain constant impedance through the adapter circuit in the mated condition.

By reason of the construction according to the present invention, the input connection is in a normal shorted position whenever the plugs are unmated, and the adapter serves as a constant-impedance transmission line whenever the plugs are mated. The above functions, moreover, are provided within an adapter structure having external dimensions no greater than the present standard form of adapter, and no external switching circuits are required.

It is, therefore, an object of this invention to provide an adapter for interconnecting to R.F. coaxial connectors, in which, within the internal dimensions of the adapters, the input circuit of one connector is shorted in the unmated condition, and in the mated condition the short is removed and the adapter functions as a constant-impedance transmission line.

An additional object of this invention is to provide such an adapter for the interconnection of bayonet and threaded type plugs.

A more specific object of this invention is to provide the functions above described by means contained entirely within the envelope of standard adapters now known in the art.

These and other objects of the invention are accomplished by the exemplary form thereof described below and shown in the accompanying drawings, in which FIG. 1 is a longitudinal cross-sectional view of an adapter according to this invention, shown in the unmated condition;

Figure 1:
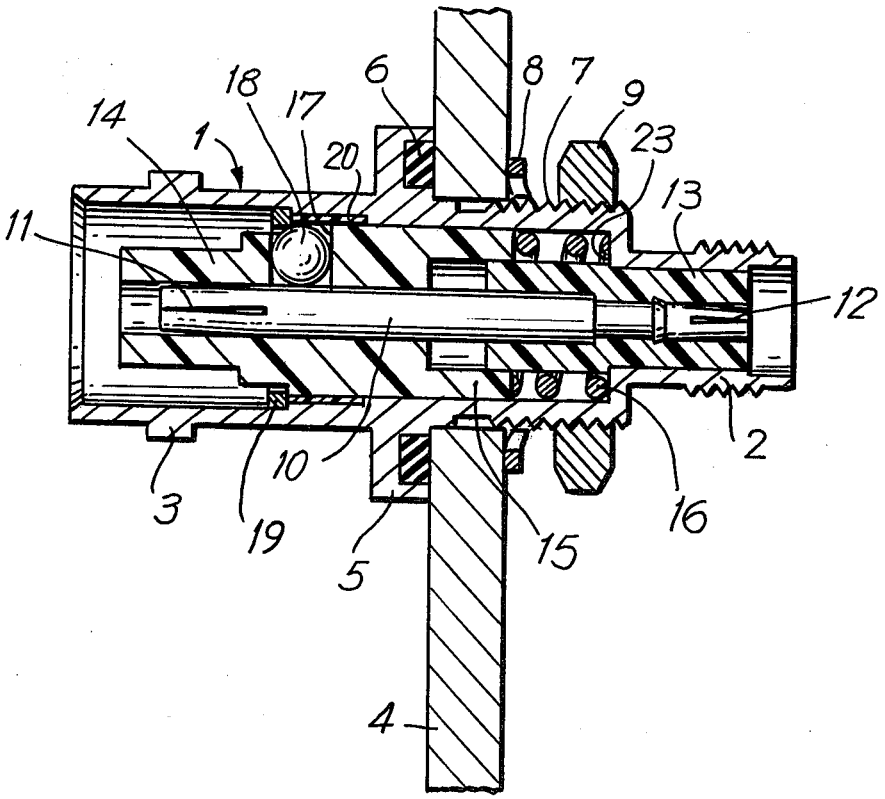

The adapter shown in FIG. 1 preferably has an outer configuration of adapters already known in the art, and normally consists of an outer, generally cylindrical metallic housing 1 having at one end an externally threaded extension 2 of smaller diameter than the main portion thereof, to receive a standard threaded type plug (not shown). The other end of the housing is preferably provided with radial extension 3 for providing mechanical connection to a bayonet type plug (not shown). Inasmuch as such adapters are normally attached to a panel 4 of the particular equipment with which they are used, they are generally provided with an enlarged radial section 5 and a gasket 6 to be positioned on one side of the panel, and a threaded section 7 carrying lock washer 8 and hex nut 9 on the other side of the panel for firmly attaching the adapter thereto.

As mentioned above, the external features of my adapter as above described are configuration and dimension-wise substantially identical to adapters now found in the prior art and while not essential to the novel details of the invention as described in more detail below, form a part of this invention to the extent they illustrate the manner in which such detailed features can be incorporated in a structure having the same size and shape of the conventional adapter.

A preferable solid center conductor 10 having hollow ends 11 and 12 for receiving the center conductors of the coaxial connectors or plugs of the devices to be interconnected (not shown) is supported at one end by insulator 13 fixed in the extension 2 and projecting into the area of housing 1 having a larger internal diameter. At its other end, the center conductor is supported by insulating sleeve 14 slidably mounted thereon and generally in slidable contact with the internal surface of the housing 1. Sleeve 14 is provided with a cup-shaped end 15 slidable over the projecting portion of insulator 13. A spring 16 surrounds the said projecting portion and normally urges the insulating sleeve 14 away from the internal shoulder 23 of the housing 1, which is formed by the external extension 2 thereof.

Figure 3:
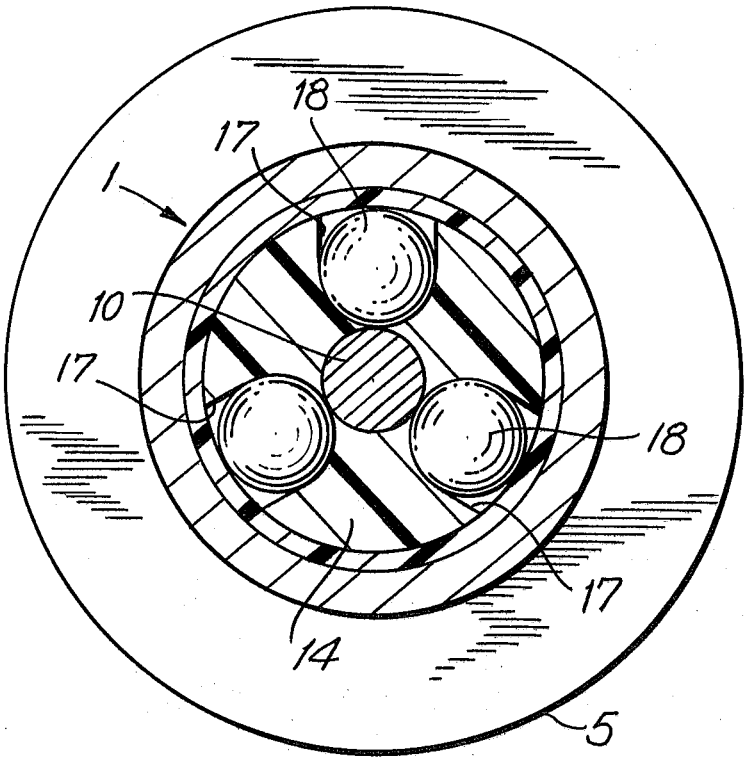
FIG. 3 is a transverse cross-sectional view of the adapter taken along the line 3—3.

Toward the end of the insulating sleeve 14 opposite to the cup-shaped end, and as is more clearly shown in FIG. 3, said sleeve is provided with one or more radial bores or openings 17 within which are placed members 18 which may preferably be in the shape of ball contacts. A metallic shoulder preferably in the form of a press-fit ring 19 is affixed internally of the housing 1, being of such diameter that, as shown in FIG. 1, it will be in electrical contact with members 18 as the spring 16 pushes sleeve 14 away from the internal shoulder 23. A small insulating sleeve 20 is positioned intermediate the inner surface of housing 1 and the outer surface of sleeve 14 and adjacent one side of metallic ring 19 for reasons hereinafter described.

As hereinbefore stated, FIG. 1 illustrates the adapter according to this invention in the unmated position. In this position, a direct electrical connection will then be made between center conductor 12 and metal housing 1, through contacts 18 and ring 19.

Figure 2:
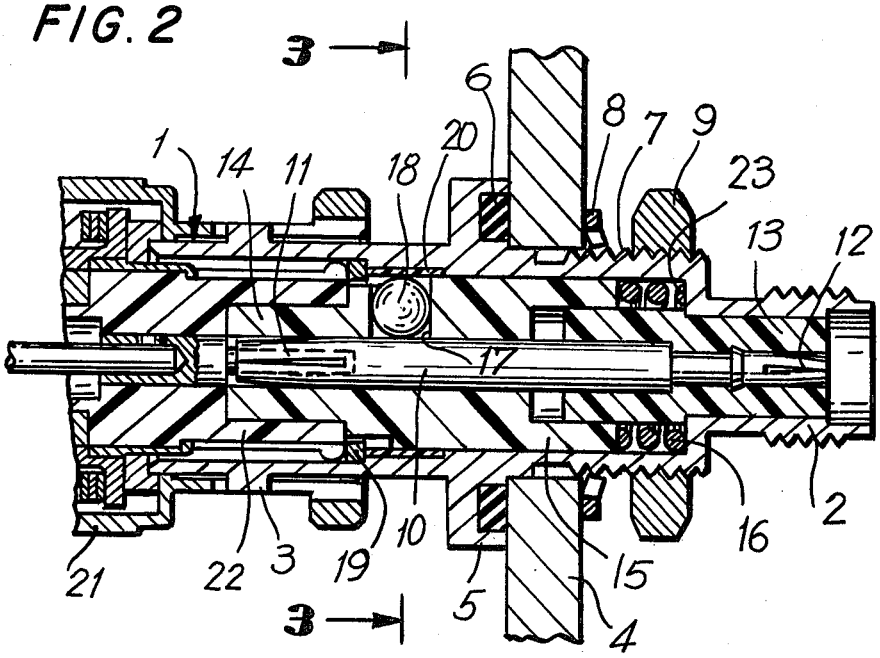
FIG. 2 is a similar view of an adapter shown in the mated condition.

FIG. 2 illustrates the action which takes place within housing 1 when, for example, a bayonet plug partially shown at 21 is attached to the adapter. In this case, the shell of the plug engages the extension 3, its center conductor mates with hollow end 11 of center conductor, and its insulating core 22, in the fully engaged position presses against insulating sleeve 14 and spring 16 to move contact members 18 out of engagement with ring 19 and under insulating sleeve 20. Assuming that the threaded plug (not shown) has been attached to the other end of the adapter in the normal manner, the adapter plug now acts as a constant impedance transmission line between the two plugs.

It is to be emphasized by reason of the present invention standard bayonet and threaded plugs may be used with, as previously stated, the shell of a standard adapter. However, the novel internal shorting/non-shorting action taking place within the adapter may be adapted within the scope of this invention to the external configurations of standard forms of adapters and connectors useful with other coaxial cable connectors or plugs other than the one illustrated for the purposes of describing this invention. Such other external configurations include within the scope of this invention those suitable for use without panel mounting, in which case the enlarged radial section 5, gasket 6, threaded section 7, lock washer 8 and hex nut 9 can be eliminated. Likewise, other types of adapters may not necessarily be formed with an internal shoulder, and various types of means urging the insulating sleeve 14 and contact members 18 against the ring 19 may be used within the scope of this invention.

While contacting members 18 preferably have the configuration of balls, cylindrical or ellipsoidal and other suitably shaped contact members may be used in suitably formed bores, provided only that they produce electrical contact between the center conductor and the shell of the adapter when the latter is in its unmated condition.

As previously stated, an adapter according to the present invention is admirably designed to provide a constant impedance connector by reason of the fact that parameters for obtaining a constant impedance condition, such as the spacing of the inner and outer conductors, the type of insulators to be used, the compensation for unwanted reflection, etc., can readily be accomplished within the design parameters described. The invention, however, is not confined to providing a constant impedance device when such is not required for the purposes in mind.

The above and other features of the invention will be apparent to those skilled in this art as more specifically set forth in the following claims.

What I claim is:

1. In an adapter plug for joining two different coaxial plugs, which comprises a generally cylindrical metal housing and provided with external means at each end for mechanically attaching said coaxial plugs to said adapter, and a center conductor having means at each end for receiving the center conductor of said coaxial plugs, the improvement which comprises a first insulating support for said center conductor, surrounding one end of the same, and rigidly mounted within said housing, a second insulating support slidably mounted within the main portion of said housing and about the other end of said center conductor, the body of said second insulating support being provided with one or more radial openings near one end, extending from the center conductor to the outer face of said insulating support, means forming a metallic shoulder within said housing and positioned adjacent said radial openings, a contact device in each of said openings extending from the center conductor to the outer surface of said second insulating support, spring means normally urging said second insulating support in a direction to press said contacting devices into engagement with said shoulder, an insulating sleeve positioned within said housing adjacent said shoulder and covering a portion of said openings when the contacting devices and the shoulder are in contact-making position, whereby movement of said second insulating support against said spring resulting from the mechanical connection of one of the coaxial plugs shifts said contacting means away from said shoulder and under the internal surface of said insulating sleeve.

2. In an adapter plug according to claim 1, in which said metal housing is formed with an extended portion of reduced diameter forming an internal shoulder within said housing, and said spring means is positioned between said internal shoulder and said second insulating means.

3. Adapter plug according to claim 2, in which said first insulating support includes a section projecting into the main portion of said housing, the said other end of said second insulating support is provided with a cup-shaped extension surrounding said projecting section, and said spring means is positioned between said cup-shaped extension and said abutment.

4. Adapter plug according to claim 1, in which said contact devices are ball contacts.

* * * * *